US011852319B2

(12) United States Patent
Parra

(10) Patent No.: US 11,852,319 B2
(45) Date of Patent: Dec. 26, 2023

(54) CONTROL MEANS FOR VORTEX FLAME DEVICE

(71) Applicant: Armando Parra, Upland, CA (US)

(72) Inventor: Armando Parra, Upland, CA (US)

( * ) Notice: Subject to any disclaimer, the term of this patent is extended or adjusted under 35 U.S.C. 154(b) by 22 days.

(21) Appl. No.: 17/702,256

(22) Filed: Mar. 23, 2022

(65) Prior Publication Data

US 2022/0275927 A1 Sep. 1, 2022

Related U.S. Application Data

(60) Provisional application No. 63/154,479, filed on Feb. 26, 2021.

(51) Int. Cl.

| | |
|---|---|
| ***F21V 11/12*** | (2006.01) |
| ***F21V 11/14*** | (2006.01) |
| ***F21V 37/00*** | (2006.01) |

(52) U.S. Cl.

CPC ..... *F21V 11/12* (2013.01); *F21V 11/14* (2013.01); *F21V 37/0004* (2013.01)

(58) Field of Classification Search

CPC . F21L 17/00; F21L 26/00; F23C 7/006; F23C 7/008; F23C 7/002; F23C 7/02; F23C 5/32; F24C 15/06; F24C 3/006; F21V 37/005; F21V 37/0054; F21V 37/0004; F21V 37/0008; F21V 37/0058; F23D 3/20; F23D 3/04; F23D 3/06; F23D 14/70; F23D 14/84; F23D 14/14; F23D 14/30;

(Continued)

(56) References Cited

U.S. PATENT DOCUMENTS 1,753,962 A * 4/1930 Lonergan ..... F23D 91/02 431/190
2,121,948 A * 6/1938 Borland ..... F23D 14/58 431/328

(Continued)

FOREIGN PATENT DOCUMENTS

CN 104913306 A 9/2015
CN 104654305 B 6/2017

(Continued)

*Primary Examiner* — Peggy A Neils
*Assistant Examiner* — James M Endo
(74) *Attorney, Agent, or Firm* — Kenneth Avila

(57) ABSTRACT

The present invention is a torch lamp for use during festive occasions having a proximal end that is capable of supporting a flame, a distal end that is open, a central axis extending from the proximal end to the distal end, a plurality of walls about the central axis defining a chamber and being radially spaced about the central axis, and one or more flame control devices. The walls substantially enclose the chamber and at least one wall is offset with respect to the central axis as to another wall such that the edge of one wall is offset from the edge of an adjacent wall forming a gap. The flame control device comprises a filter portion and a handle portion. The filter portion may be planar or nonplaner and contains one or more cutouts. The handle portion extends away from the filter portion and is used to maneuver the flame control device over the flame. One or more flame control devices may be positioned over the flame through gaps formed between the offset walls. Cutouts found on the filter portion alter the configuration of the flame and the flame's intensity.

14 Claims, 10 Drawing Sheets

(58) Field of Classification Search
CPC ..... F23D 2203/101; F23D 2203/102; F23D 2203/103; F23D 2203/106; F23D 2203/1026; F23D 2203/1023; F23D 2206/0068; F23D 2206/0073; F23D 2206/0078; F23D 2206/0084; F23D 2206/0089; F23D 2206/0094; F23D 2206/0042; F23D 14/465; F23D 14/145; F23D 14/147; F23D 14/148; F23D 14/151; F23D 2900/11403; F23D 2900/11401
See application file for complete search history.

(56) References Cited

U.S. PATENT DOCUMENTS 2,462,704 A * 2/1949 Zink ..... F23D 14/00 239/560
2,657,741 A * 11/1953 Brierly ..... F23C 7/002 137/802
2,905,235 A * 9/1959 Dolby ..... F23D 14/84 431/350
3,187,523 A * 6/1965 Kilbourn ..... F23D 14/84 431/351
3,630,649 A * 12/1971 Hancock ..... F23D 14/48 239/499
4,313,721 A * 2/1982 Henriques ..... F23D 11/406 431/351
4,934,927 A * 6/1990 Swiatosz ..... F23D 14/70 431/170
5,055,031 A * 10/1991 Werner ..... F24C 15/06 431/126
5,540,213 A * 7/1996 Shell ..... F23D 11/40 431/168
5,597,301 A * 1/1997 Roy ..... F23D 14/70 431/350
5,921,766 A * 7/1999 Dobbeling ..... F23C 7/002 431/350
5,921,770 A * 7/1999 Sattelmayer ..... F23D 17/002 431/351
5,961,320 A * 10/1999 Drago ..... F23D 14/70 126/110 R
6,065,963 A * 5/2000 Dewaegheneire .... F23D 14/145 431/329
6,140,658 A * 10/2000 Jarvinen ..... F23D 14/125 431/363
6,261,088 B1 * 7/2001 Butler ..... F21V 35/00 431/290
6,478,577 B1 * 11/2002 Maricic ..... F23D 14/04 431/353
6,991,452 B1 * 1/2006 Semaan ..... B29C 53/086 431/291
7,175,424 B2 2/2007 Frink et al.
8,939,759 B2 * 1/2015 Mori ..... F23D 14/26 431/114
9,163,831 B2 10/2015 Chen
9,360,208 B2 6/2016 Chen et al.
9,377,187 B2 6/2016 Chen
9,557,051 B2 1/2017 Chen
9,726,368 B2 8/2017 Chen
9,726,370 B2 * 8/2017 Hiraga ..... F23D 14/62
10,101,036 B2 * 10/2018 Fuller ..... F24C 15/002
10,197,291 B2 2/2019 Rivera
10,920,987 B2 2/2021 Myers et al.
2002/0072023 A1 * 6/2002 Shook ..... F21L 19/00 362/180
2004/0033461 A1 * 2/2004 Hart ..... A47J 37/0713 431/126
2005/0042558 A1 * 2/2005 Li ..... F23D 14/74 431/8
2005/0250064 A1 * 11/2005 Chesney ..... F23C 7/002 431/353
2006/0141412 A1 * 6/2006 Masten ..... F23D 14/145 431/326
2007/0054228 A1 * 3/2007 Fogliani ..... F23D 14/58 431/354
2009/0016048 A1 * 1/2009 McBrien ..... F21L 17/00 362/180
2010/0273120 A1 * 10/2010 Ten Hoeve ..... F23D 14/10 431/328
2012/0006316 A1 * 1/2012 Shimek ..... F23L 1/02 126/518
2012/0178035 A1 * 7/2012 Chen ..... F23D 5/04 431/354
2012/0231403 A1 * 9/2012 Chen ..... F23C 7/02 431/353
2013/0011800 A1 * 1/2013 Chen ..... F23D 5/045 431/344
2013/0252188 A1 * 9/2013 Chen ..... F23D 14/10 431/355
2013/0273485 A1 * 10/2013 Lenoir ..... F23D 14/145 126/92 AC
2014/0227646 A1 * 8/2014 Krichtafovitch ..... F23N 5/00 431/2
2014/0290643 A1 * 10/2014 Potter ..... F23C 7/004 431/126
2015/0167962 A1 * 6/2015 Chen ..... F23D 3/20 431/353
2015/0167963 A1 * 6/2015 Chen ..... F23C 7/002 431/353
2015/0167964 A1 * 6/2015 Chen ..... F23D 3/20 431/353
2016/0161113 A1 * 6/2016 Takeuchi ..... F23D 14/145 431/328
2016/0298840 A1 * 10/2016 Karkow ..... F23C 99/001
2016/0363280 A1 * 12/2016 Angelotti ..... B05B 17/0607
2017/0336069 A1 * 11/2017 Parra ..... F23D 3/02
2018/0010790 A1 * 1/2018 Huang ..... F23C 7/004
2018/0112867 A1 * 4/2018 Huitsing ..... F23D 14/02

FOREIGN PATENT DOCUMENTS

CN 107842870 A 3/2018
CN 105910102 B 4/2018
DE 202007018478 U1 9/2008
DE 202010000376 U1 6/2010
DE 102014110458 B4 3/2017
DE 102018121946 A1 3/2020
EP 2098781 A2 9/2009
EP 2886954 A1 6/2015
EP 2916070 A2 9/2015
EP 3636997 B1 12/2020
TW 201303226 A 1/2013
WO 2020069770 A1 4/2020

* cited by examiner

CONTROL MEANS FOR VORTEX FLAME DEVICE

CROSS-REFERENCE TO RELATED APPLICATIONS

This application claims priority from U.S. Provisional Patent Application No. 63/154,479 filed on Feb. 26, 2021. The entire disclosure of the prior application is considered to be part of the disclosure of the accompanying application and is hereby incorporated by reference.

BACKGROUND OF THE INVENTION

1. Field of the Invention

This invention relates to aesthetically pleasing torch lamps that produce an elongated spiral flame effect for entertainment purposes. More particularly to a means that allows users of a torch lamp to easily and dynamically alter the intensity and configuration of the flame, further enhancing the entertainment value of the torch lamp.

2. Description of the Related Art

Torch lamps may be used for a variety of purposes such as outdoor lighting, marking walkways, festive lighting, ambiance lighting, providing warmth, and more. Torch lamps may be permanently installed such as when used for outdoor lighting or marking a walkway. Generally, permanently installed torch lamps are connected to a permanent fuel source so that they may burn for an indefinite period of time. Torch lamps may also be temporarily installed when used for festivities. Generally, temporarily installed torch lamps are not connected to a permanent fuel source but include a reservoir where a combustible fuel source is contained therein. As such temporarily installed torch lamps may only burn for a defined period of time.

It is desirable for the flame produced by a torch lamp to maintain a certain shape, as normally flames do not maintain a shape. Many times this is done by controlling the amount and the flow of air about the flame to create a vortex about the flame in order to induce the flame to spiral. This produces a very desirable visual effect of the flame. Other means of inducing the flame to maintain a certain shape are to control the volume of the flame, the number of sources that produce the flame, or by altering the shape of the outlet from which the flame originates.

FIG. 1 shows a torch lamp having reservoir 14 containing combustible fuel with a flame 18 originating from reservoir 14. Here, flame 18 is protected from being blown about by the wind by a cylindrical piece of glass, shield 16, that is open on either end and fitted over flame 18 above reservoir 14. As shown, reservoir 14 sits above base 12. Although such a torch lamp protects flame 18 from being blown about by the wind, it is difficult otherwise to control the flame dynamically. Some embodiments do exist where the volume of flame 18 may be dynamically changed by altering the amount of air being fed to the flame from the base but generally shield 16 must be removed to add an additional wick. Altering the configuration of flame 18 may be done by modifying the number of sources for flame 18 or by applying a mask or filter by means of a flame control device at the flame's point of origin. Here, shield 16 must be removed from the torch lamp in order to change the number of wicks or to add and remove flame control devices. Additionally, since shield 16 becomes hot to the touch, it may only be removed after it has cooled.

FIG. 2 shows another torch lamp design. It differs from the torch lamp of FIG. 1 in that shield 16 is comprised of three curved panels of glass: 16*a*, 16*b*, and 16*c*, which together make a shield that encloses chamber 20. This arrangement of glass panels not only protects flame 18 from being blown about by the air, but the gaps between the overlapping panels of glass admit air in such a manner as to create a vortex within the cylinder and induce flame 18 to spiral. However, in such designs, it is difficult to change the configuration of flame 18. The glass panels are typically fixed to base 12 of the torch lamp or to a frame that goes about the panels and cannot be easily removed to change the arrangement of wicks or the flame control device above the wick(s).

Known torch lamps do not provide a means of easily or dynamically controlling the number of flames or altering the shape of the flame at its base. As torch lamps are intended to be decorative and pleasurable to the eye, it is advantageous to alter the number of flames or the shape of the flame at its base easily or dynamically. A torch lamp with such features would add to the festivities as different torch lamps may have different flame configurations or that the flame configuration may be easily changed during the event.

BRIEF SUMMARY OF THE INVENTION

The present disclosure is directed generally toward a means for configuring the flame within a torch lamp and related lamps having shields that are comprised of two or more panels. The means comprise the placement of one or more flame control devices over a central flame or flames. A flame control device is composed of a filter portion containing one or more cutouts with a handle portion attached to the filter portion for handling by the user of the flame control device. Cutouts may take the form of a shape such as a circle or a rectangle. Cutouts may also be of an irregular shape such as logos or images of a jet or a house. There may be one or more cutouts on the filter portion of the flame control device. Additionally, the cutouts may be uniformly positioned on the filter portion or they may be positioned in a non-uniform arrangement. The flame control devices may be stacked or unstacked one atop of another above the origin of the flame to alter the configuration of the flame so as to change the number of flame streams and/or their intensity. To add or remove a flame control device, a handle is provided. A user will grasp the handle to place a flame control device over the flame, or over another flame control device, or to remove a flame control device. The handle portion may be insulated so as not to burn the skin of the user who is handling the flame control device. The handle portion may also have hooks at the end to facilitate the organization of flame control devices by hanging them. The handle portion may also have a projection to prevent the flame control devices from being inserted too far into chamber 20. The handle portion may be straight or with a curvature.

The flame control devices provide users of a torch lamp having a shield comprised of two or more offset panels with an inexpensive means of controlling the intensity of the flame and altering its shape. A more intense flame also casts greater light and reduces the amount of smoke or soot that is produced by the flame that darkens the glass shield and has an unpleasant odor.

Flame control devices may also be supported at some height above the burner by the use of ring-shaped supports.

The ring is placed about the origin of the flame and the flame control devices may be placed on top of the ring. Increasing the distance between the flame's origin and any flame control devices above it will generally reduce the rate of combustion as it becomes more difficult for air to fuel the flame. The rings may have varying heights.

Neither this summary nor the following detailed description defines or limits the invention. The invention is defined by the claims.

BRIEF DESCRIPTION OF DRAWINGS

The present invention will become more fully understood from the detailed description and accompanying drawings. Other systems, methods, features, and advantages of the invention will be or will become apparent to one with skill in the art upon examination of the following figures and detailed description. It is intended that all such additional systems, methods, features, and advantages be included within this description, be within the scope of the invention, and be protected by the accompanying claims. Component parts shown in the drawings are not necessarily to scale and may be exaggerated to better illustrate the important features of the invention. In the drawings, like reference numerals may designate like parts throughout the different views, wherein:

DETAILED DESCRIPTION OF THE INVENTION

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Figure 1:
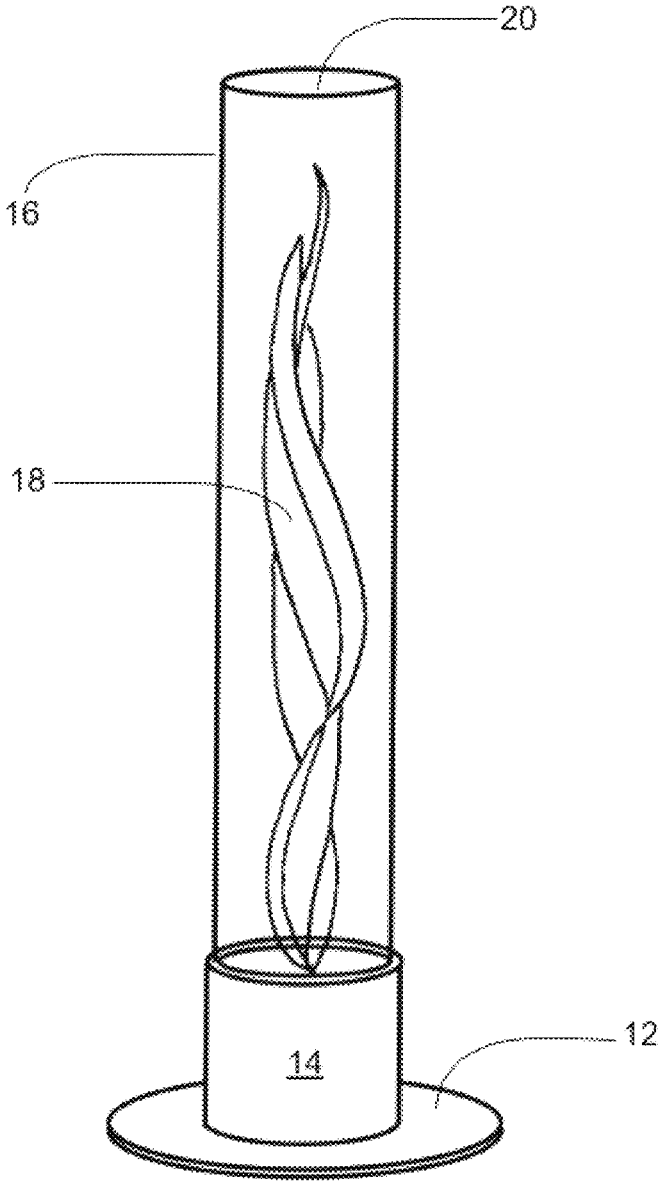
FIG. 1 (Prior Art)
FIG. 1 shows a first embodiment of a torch lamp of the prior art.
Figure 2:
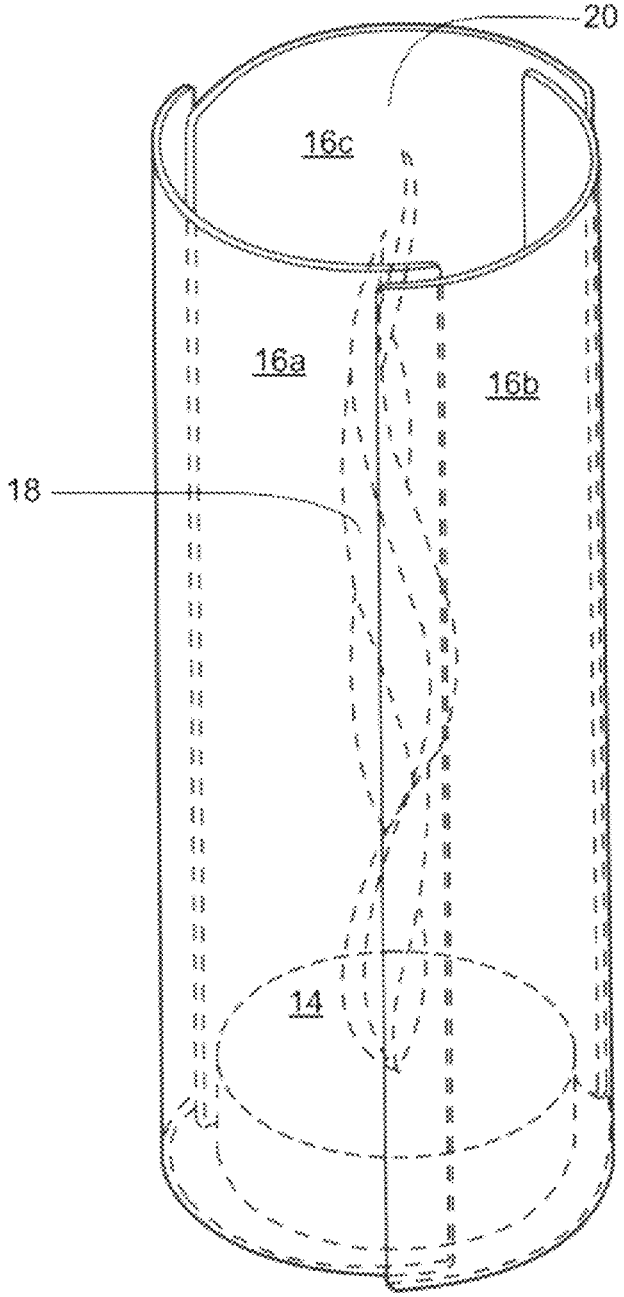
FIG. 2 (Prior Art)
FIG. 2 shows a second embodiment of a torch lamp of the prior art.
Figure 3:
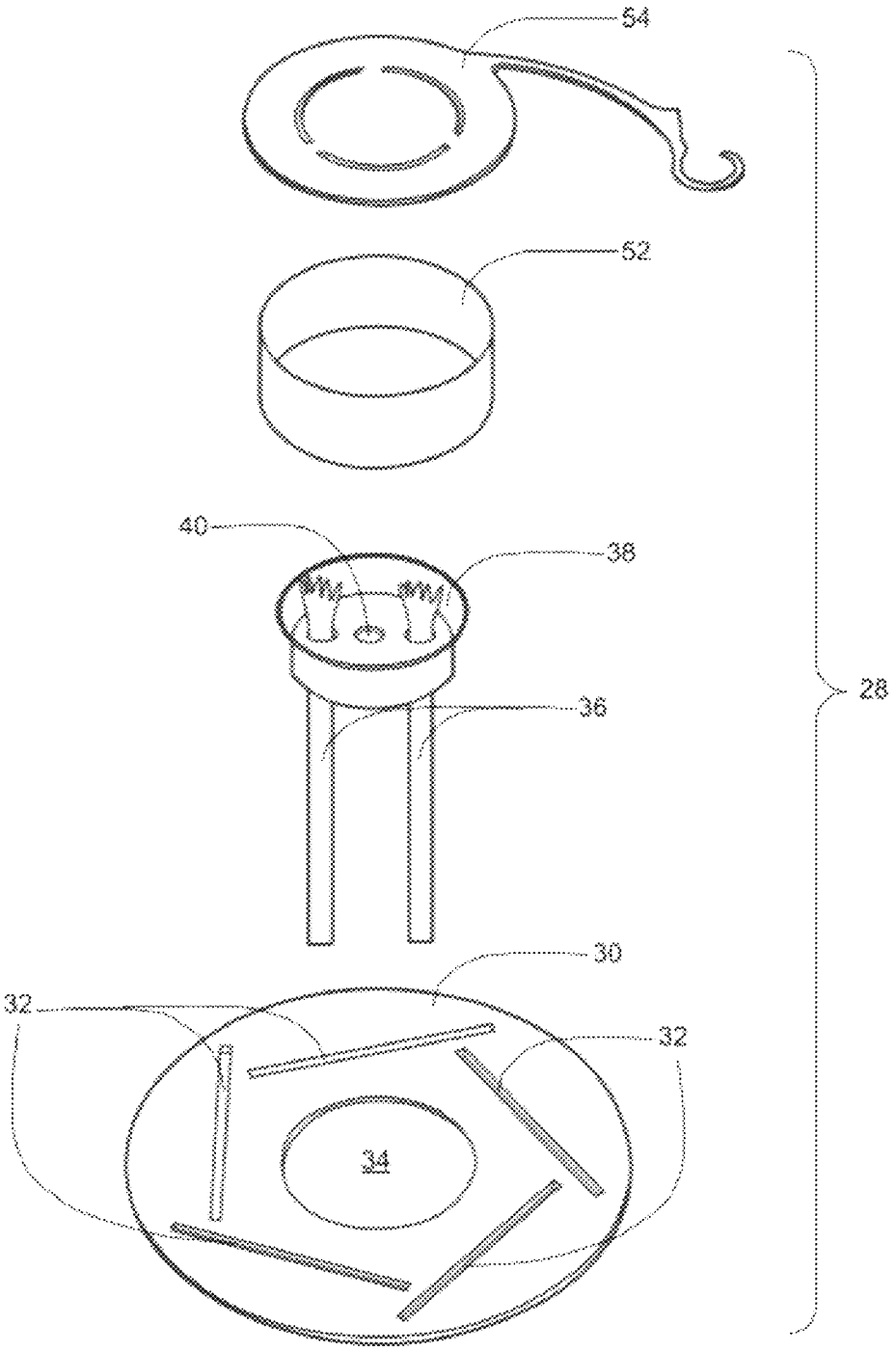
FIG. 3 shows an exploded view of a torch lamp assembly that uses an oil-based combustible fuel, the view showing the orientation of the flame control device and ring in relation to other components.

Turning to FIG. 3, oil burner assembly 28 is shown. This assembly is used when oil is the fuel for combustion and wicks are used as the combustion medium. Only the core elements of the burner assembly are shown so as to orientate flame control device 54 with the remaining components of oil burner assembly 28. The reservoir, glass panels, mounting pole, and others, are not shown in order to preserve clarity. Starting from the bottom and working upwards we have first base plate 30. About the center of base plate 30 is reservoir opening 34 which provides access to a reservoir holding a combustible fuel such as oil or alcohol. Also, base plate 30 contains slots 32 and in this particular embodiment, there are five slots 32 arranged circumferentially about reservoir opening 34. Each slots 32 is configured to hold one panel of glass. The panels of glass are arranged in such a manner that outside air may enter the space about wicks 36 through the gaps between each panel, basically forming chamber 20. Each panel is also set at an angle from adjacent panels to encourage the air entering chamber 20 to circulate in a particular direction so as to create a vortex within the space and cause the flame to spiral. Above base plate 30 is burn well 38 which is inserted into reservoir opening 34. In oil burner assembly 28, two wicks 36 are shown but other arrangements of wicks 36 are possible. In addition, burn well 38 contains refill opening 40 so that reservoir 14, not shown, may be easily refilled. Above burn well 38 is ring 52. The purpose of ring 52 is to provide some spacing between the tops of wicks 36 and flame control device 54. Changing the distance between the top of wicks 36 and flame control device 54 will alter the flame's configuration and intensity. Placing flame control device 54 directly on top of wicks 36 will cause the flame to become more intense and encourage the flame to more closely follow the cutouts present on flame control device 54. When ring 52 is placed over burn well 38. the only air that is accessible to the flame will be drawn from the opposite end of ring 52 which, when covered by flame control device 54, reduces the volume of air that may be fed to the flame. Above ring 52 is flame control device 54 which may be placed directly on top of wicks 36 if ring 52 is not used or on top of ring 52 as shown in FIG. 3. Generally, flame control device 54 is placed on top of wicks 36 or ring 52 by first holding flame control device 54 using handle portion 64 in a vertical orientation, then inserting flame control device 54 through a gap between a pair of glass panels, and finally orienting flame control device 54 horizontally and placing it on wicks 36 or ring 52. Multiple flame control device 54 may be placed on wicks 36 or ring 52 to alter the configuration and intensity of the flame. Moreover, flame control device 54 may be added or removed, even if the flame is active, by grasping the distal end of handle portion 64 and reversing the steps used for inserting the flame control device 54. Finally, flame control device 54 may be inserted within different gaps between the glass panels as shown in FIG. 6C where two flame control device 54 have been placed on top of wicks 36 or burn well 38.

Figure 4:
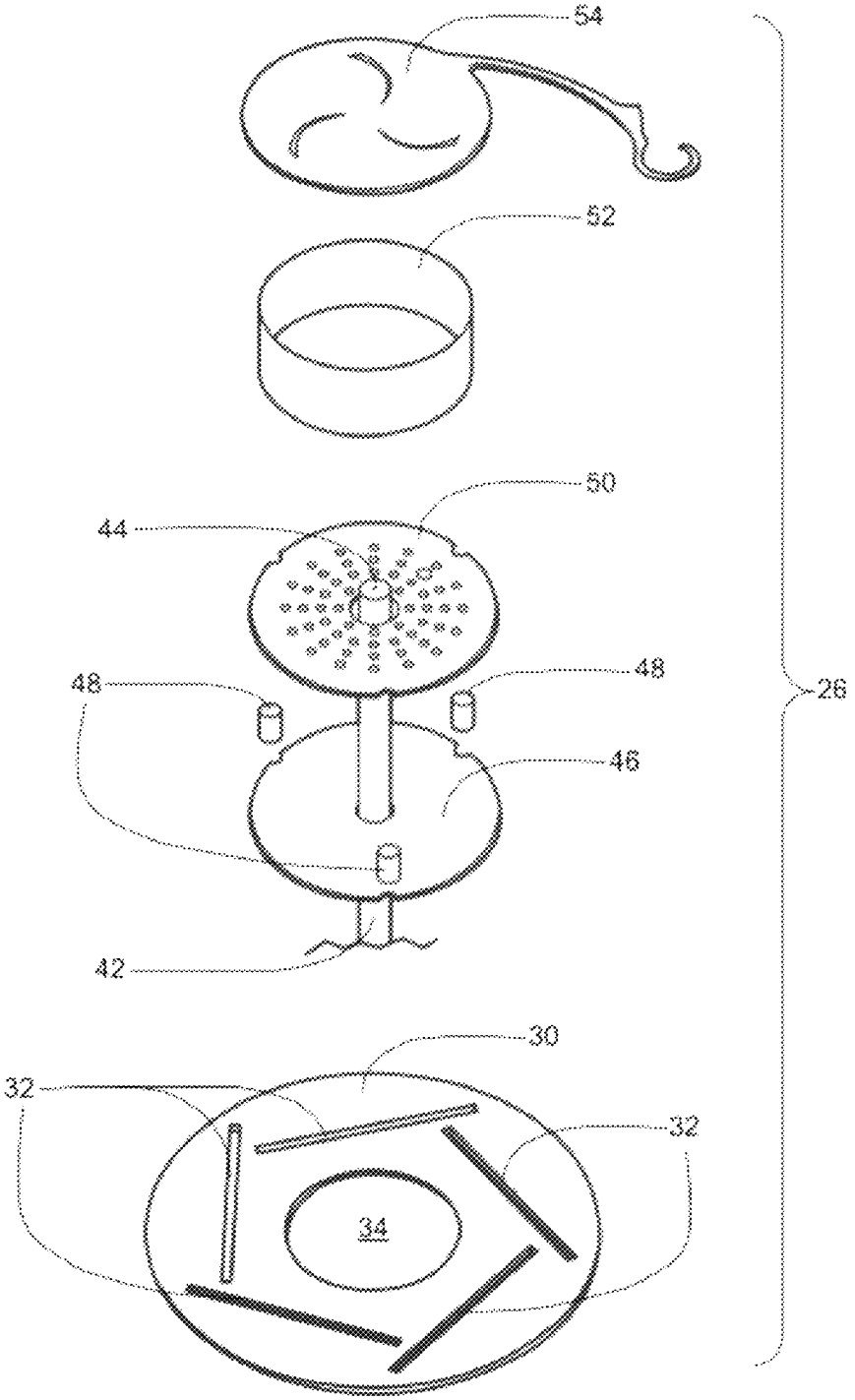
FIG. 4 shows an exploded view of a torch lamp assembly that uses natural gas or propane as fuel, the view showing the orientation of the flame control device and ring in relation to other components.
Figure 5A:
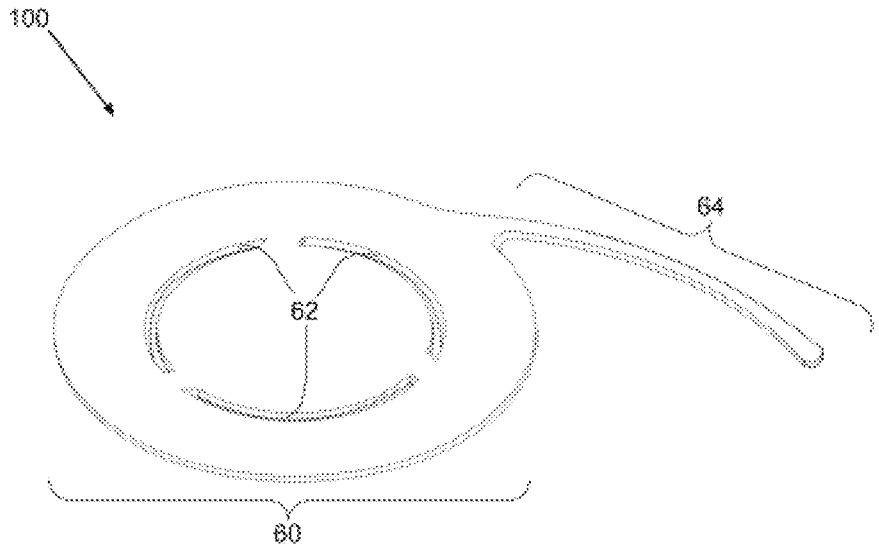
FIG. 5A shows the first embodiment of the flame control device of the present invention.
Figure 5B:
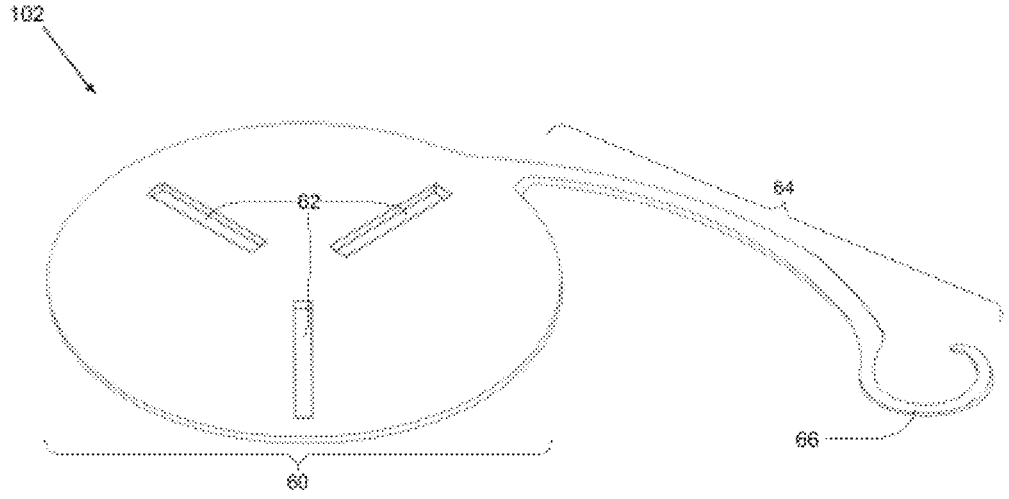
FIG. 5B shows a second embodiment of the flame control device of the present invention.
Figure 5C:
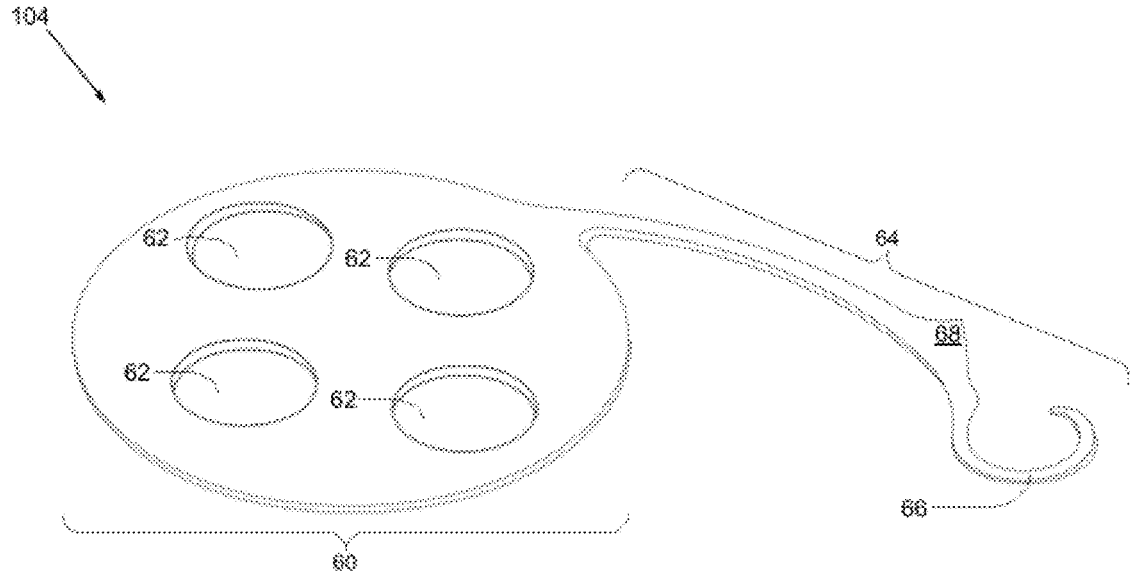
FIG. 5C shows a third embodiment of the flame control device of the present invention.
Figure 5D:
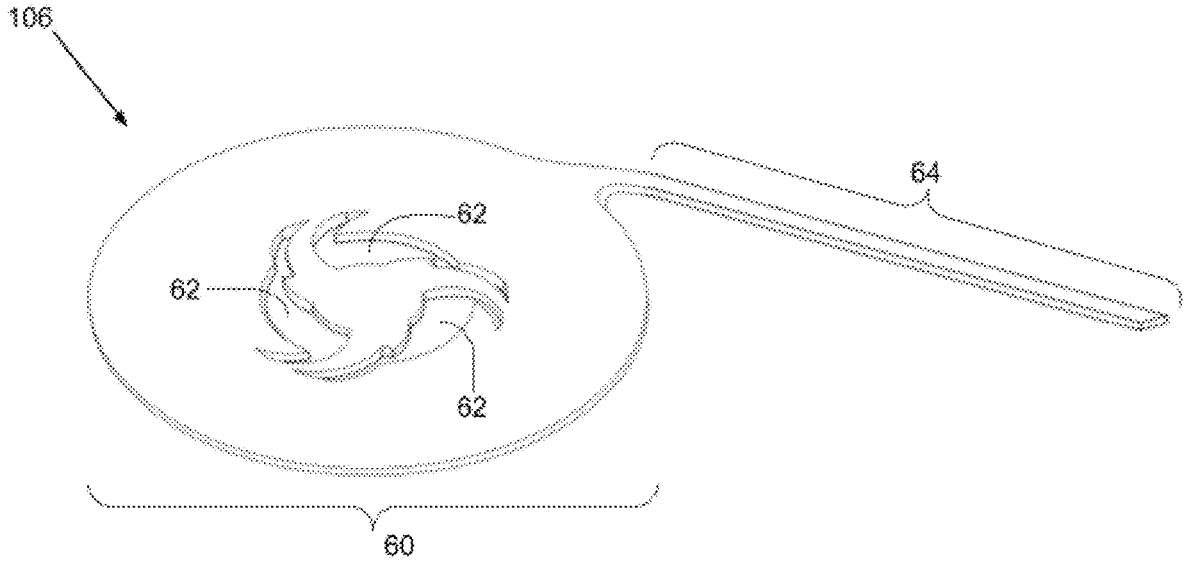
FIG. 5D shows a fourth embodiment of the flame control device of the present invention.
Figure 5E:
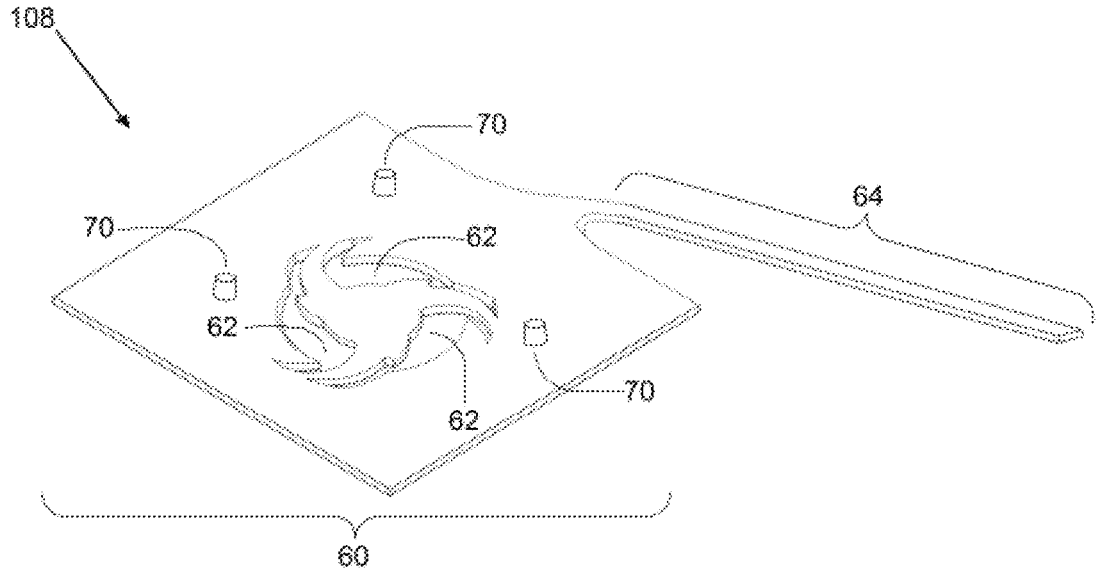
FIG. 5E shows a fifth embodiment of the flame control device of the present invention.
Figure 5F:
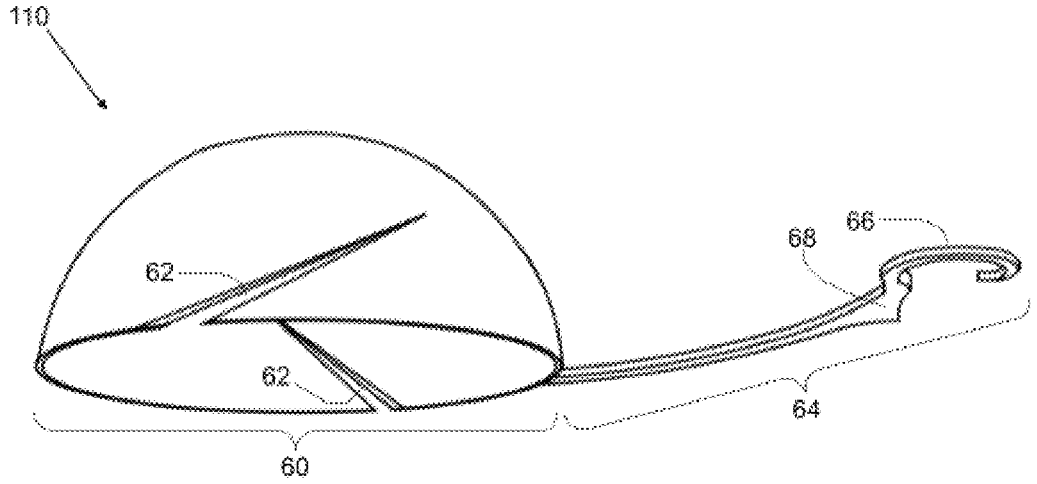
FIG. 5F shows a sixth embodiment of the flame control device of the present invention.

Turning now to FIG. 4, gas burner assembly 26 is shown. This assembly is used when a gas that is under pressure, such as propane, is the fuel for combustion and a nozzle at the end of a gas line is the combustion point. Only the core elements of the burner assembly are shown so as to orientate flame control device 54 with the remaining components of gas burner assembly 26. The tank pressurized with gas, glass panels, mounting pole, and others, are not shown in order to preserve clarity. Starting from the bottom and working upwards we have first base plate 30 which is identical to base plate 30 of oil burner assembly 28. As in oil burner assembly 28, base plate 30 contains five slots 32 arranged circumferentially about reservoir opening 34. Each slots 32 is configured to hold one panel of glass. The panels of glass are arranged in such a manner that outside air may enter the space about nozzle 44 through the gaps between each panel, basically forming chamber 20. Each panel is also set at an angle from adjacent panels to encourage the air entering chamber 20 to circulate in a particular direction so as to create a vortex within the space and cause the flame to spiral. Other embodiments may have fewer or a greater number of glass panels. About the center of base plate 30 is reservoir opening 34 which provides an opening for gas line 42 to be passed through. Gas line 42 passes through this opening and continues through firewall 46 and air mix plate 50. During assembly, reservoir opening 34 is covered by firewall 46. To allow for air to feed the flame, spacers 48 are used to separate firewall 46 from air mix plate 50. Air may then enter between firewall 46 and air mix plate 50 and pass through the openings in air mix plate 50 to feed the flame at nozzle 44. Above air mix plate 50 is ring 52. The purpose of ring 52 is to provide some spacing between nozzle 44 and flame control device 54. Changing the spacing between nozzle 44 and flame control device 54 alters the flame's configuration and intensity. Decreasing he distance between flame control device 54 and the top of nozzle 44 will cause the flame to more closely follow the cutouts present on flame control device 54, Increasing the distance between flame control device 54 and the top of nozzle 44 will cause the flame to more loosely follow the cutouts present on flame control device 54. Generally, flame control device 54 is placed on top of ring 52 by first holding flame control device 54 using handle portion 64 in a vertical orientation, then inserting flame control device 54 through a gap between a pair of glass panels, and finally orienting flame control device 54 horizontally to place it on ring 52. Multiple flame control device 54 may be placed on ring 52 to alter the configuration and intensity of the flame. Moreover, flame control device 54 may be added or removed, even if the flame is active, by grasping the distal end of handle portion 64 and reversing the steps used for inserting the flame control device 54. Finally, flame control device 54 may be inserted within different gaps between the glass panels as shown in FIG. 6C where two flame control device 54 have been placed on top of ring 52.

Turning now to the family of figures represented by FIG. 5, we see varying embodiments for flame control device 54 which consists of a filter portion 60 and handle portion 64. In FIG. 5A we show first flame control device embodiment 100 which contains three cutouts 62, each configured in the shape of an arc, that are equally spaced circumferentially about the center of filter portion 60. In first flame control device embodiment 100, handle portion 64 is shown in the general shape of an arc in order to more easily place flame control device 54 directly above the flame. In FIG. 5B we show second flame control device embodiment 102. In contrast to first flame control device embodiment 100, cutouts 62 are rectangular-shaped rather than being in the shape of an arc. Additionally, second flame control device embodiment 102 handle portion 64 contains hook 66 so that when not in use, flame control device 54 may be hung on an appropriately sized horizontal rod. In FIG. 5C we show third flame control device embodiment 104. In contrast to first flame control device embodiment 100, cutouts 62 are circular-shaped rather than being in the shape of an arc. Additionally, third flame control device embodiment 104 handle portion 64 contains projection 68 which prevents flame control device 54 from being inserted too far into chamber 20. In FIG. 5D we show fourth flame control device embodiment 106. In contrast to first flame control device embodiment 100, cutouts 62 are irregular in shape. In this particular case, cutouts 62 are in the form of a logo rather than being in the shape of an arc. Additionally, fourth flame control device embodiment 106 handle portion 64 is linear. In FIG. 5E we show fifth flame control device embodiment 108 which is similar to fourth flame control device embodiment 106 with the exception that fifth flame control device embodiment 108 filter portion 60 is rectangular rather than circular and contains lifts 70 to increase the distance between flame control devices 54. In FIG. 5F we show sixth flame control device embodiment 110 which, unlike earlier embodiments where filter portion 60 is generally planar, has a filter portion 60 which generally takes the shape of a dome with cutouts 62 that appear as angular slits on the surface of the dome. Attached to filter portion 60 is handle portion 64 which contains projection 68 and hook 66 at its distal end. Other possible embodiments for flame control device 54 may include cutouts 62 along the edge of filter portion 60, filter portion 60 having shapes other than circular or rectangular, and other such features that may be envisioned by one with skill in the art.

Figure 6A:
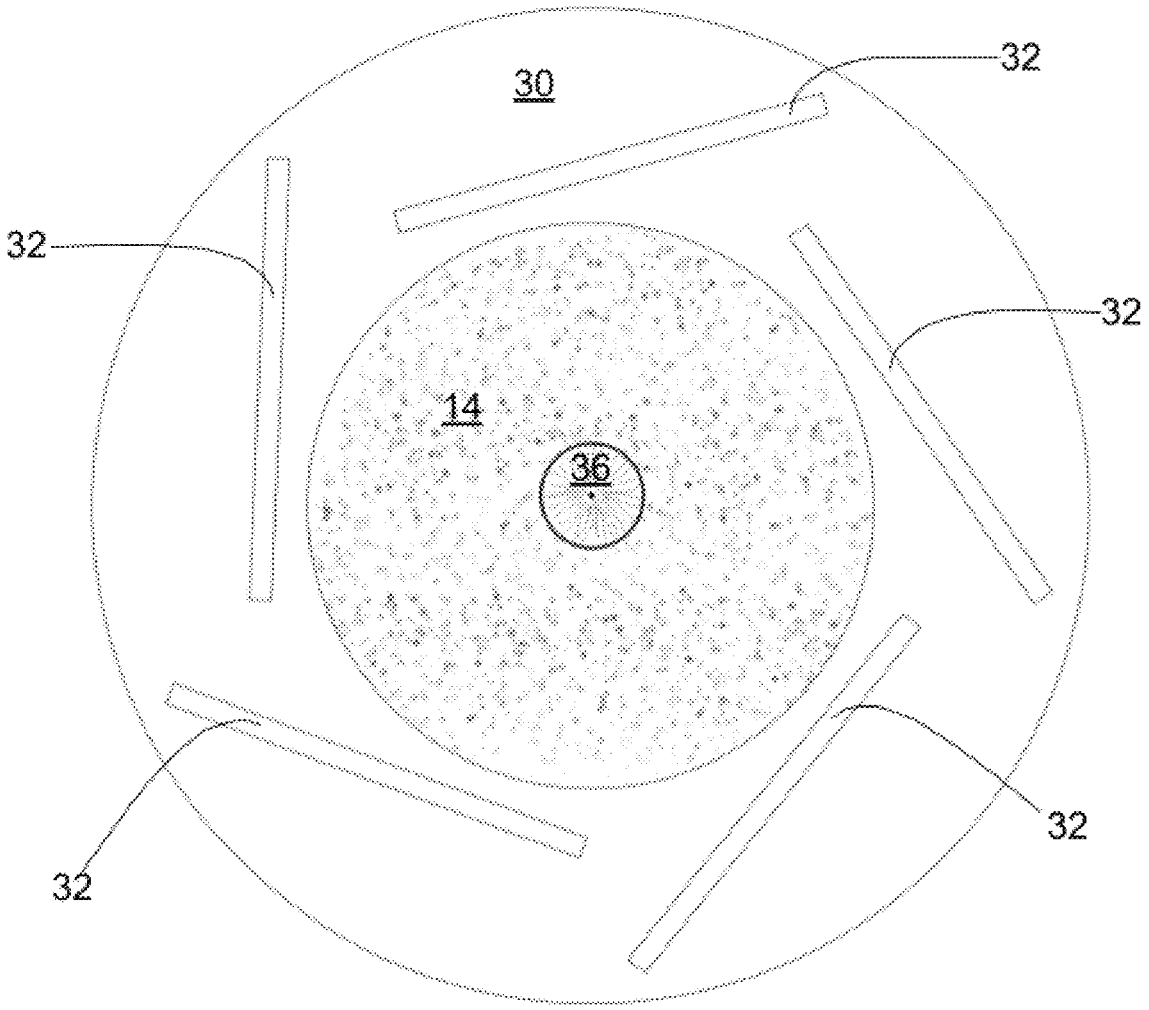
FIG. 6A shows a top view of the torch lamp assembly of FIG. 3 without any flame control devices installed.
Figure 6B:
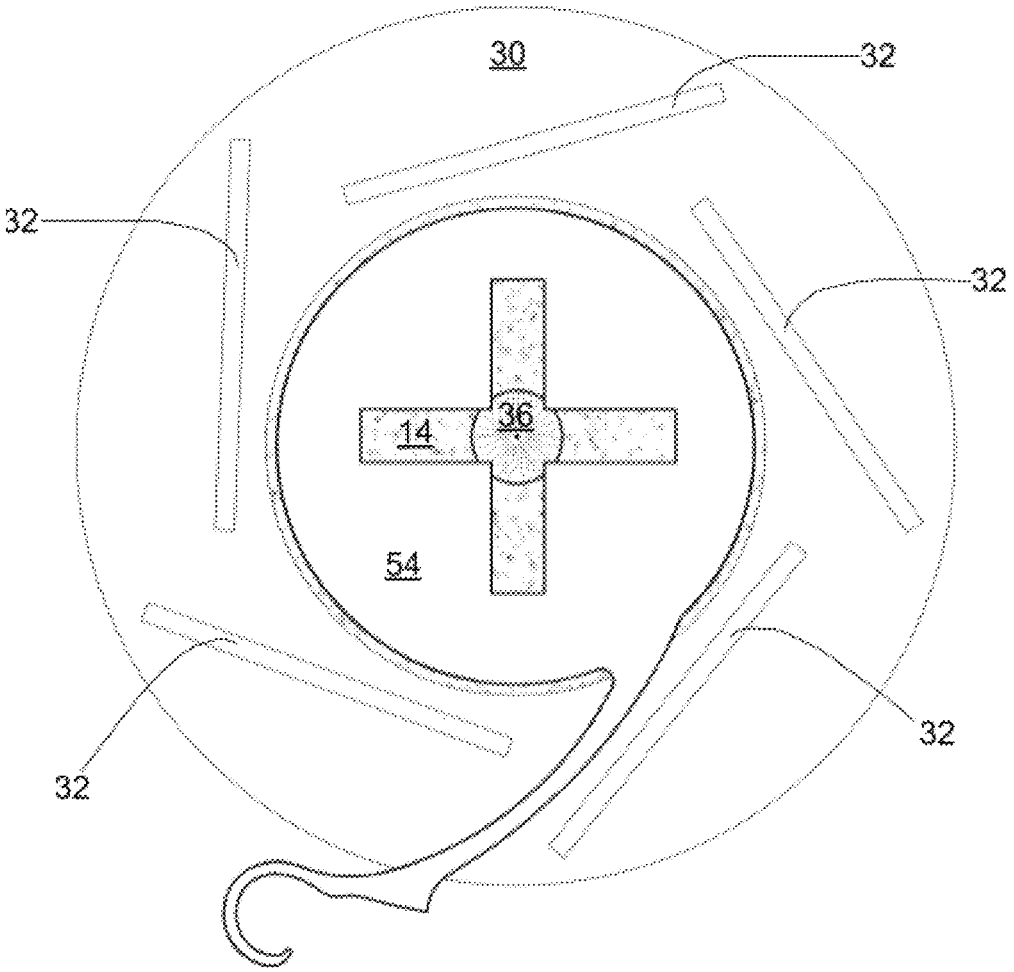
FIG. 6B shows a top view of the torch lamp assembly of FIG. 3 with one flame control device placed above the wick, the flame control device having a cross-shaped cutout.
Figure 6C:
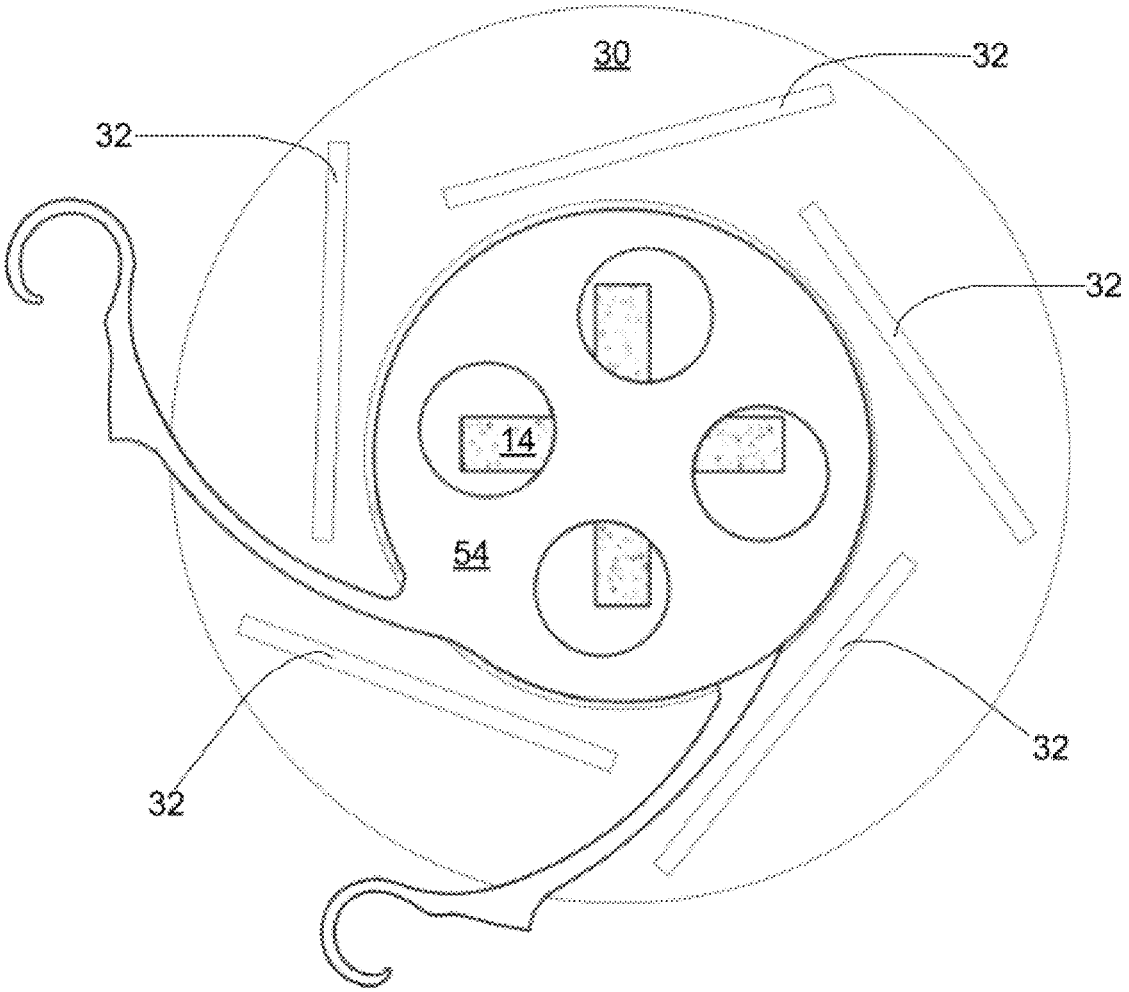
FIG. 6C shows a top view of the torch lamp assembly of FIG. 6B with a flame control device having four circular cutouts placed above a flame control device having a cross-shaped cutout.

Turning now to the family of figures represented by FIG. 6, we show a top view of base plate 30 as used in oil burner assembly 28 having reservoir 14 containing a combustible fuel in the form of a gel with a single wick 36 inserted within the gel. The purpose of this family of figures is to show how flame control device 54 may be stacked one on top of another. In FIG. 6A, base plate 30 is shown without the placement of a flame control device 54. As such, wick 36 is fully exposed and the flame produced is only altered by whatever air is found passing between the glass panels that have been inserted into slots 32. In appropriate conditions, the air will cause the flame to spiral and give it a pleasing appearance. In FIG. 6B, a single flame control device 54 has been placed over wick 36, the flame control device 54 having cutouts 62 in the form of a plus sign. As such, the base of the flame also take the form of a plus sign. The user may further configure the flame by adding a second flame control device 54 as shown in FIG. 6C. In FIG. 6C the second flame control device 54 has four circular cutouts 62 and is placed over the first flame control device 54 by utilizing a different gap between slots 32. As such, the base of the flame will now appear as four separate flames being roughly rectangular. By using flame control device 54 with varying cutouts 62 and at different orientations, the base flame may be modified and given an appearance that is visually pleasing.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed and that that scope shall not be restricted, except in the light of the appended claims and their equivalents.

What is claimed is:

1. A torch lamp comprising:

a bottom of the torch lamp that is capable of supporting a flame, a top opposite said bottom, and a central axis extending from said bottom to said top;

a base plate at said bottom having an opening configured to receive a combustion source as fuel for a flame;

a plurality of walls about said central axis defining a chamber said walls having:

a lower end mounted on said base plate;

a higher end opposite said lower end;

a first edge extending longitudinally between said lower end and said higher end; and a second edge opposite said first edge;

wherein at least one wall of the plurality of walls is offset with respect to said central axis with another wall of the plurality of walls such that said first edge of said one wall is offset from said second edge of said another wall forming a gap therebetween; and at least one flame control device that passes through said gap comprising:

a filter portion containing one or more cutouts for altering the flame when deposited upon said combustion source; and a handle portion extending from said filter portion and beyond said gap to be utilized for safely depositing or removing said filter portion from said combustion source.

2. The torch lamp of claim 1 wherein said walls are substantially transparent.

3. The torch lamp of claim 1 wherein said walls are colored.

4. The torch lamp of claim 1 wherein said filter portion is planar.

5. The torch lamp of claim 1 wherein said filter portion is nonplanar.

6. The torch lamp of claim 1 wherein said cutouts are symmetrical about the center of said filter portion.

7. The torch lamp of claim 1 wherein said cutouts are rectangular.

8. The torch lamp of claim 1 wherein said cutouts are circular.

9. The torch lamp of claim 1 wherein said cutouts are irregular.

10. The torch lamp of claim 1 wherein said handle portion is substantially linear.

11. The torch lamp of claim 1 wherein said handle portion is substantially an arc.

12. The torch lamp of claim 1 wherein said handle portion contains a hook at its distal end.

13. The torch lamp of claim 1 wherein said handle portion contains a projection at its distal end.

14. The torch lamp of claim 1 wherein said filter portion contains one or more lifts to create space between said flame control devices.

* * * * *